US006578865B1

(12) United States Patent
Chaput

(10) Patent No.: US 6,578,865 B1
(45) Date of Patent: Jun. 17, 2003

(54) BOARD BINDING

(75) Inventor: Guillaume Chaput, Moirans (FR)

(73) Assignee: Emery SA, Saint Egreve (FR)

( * ) Notice: Subject to any disclaimer, the term of this patent is extended or adjusted under 35 U.S.C. 154(b) by 0 days.

(21) Appl. No.: 09/698,803

(22) Filed: Oct. 27, 2000

(30) Foreign Application Priority Data

Oct. 28, 1999 (FR) ..... 99 13757

(51) Int. Cl.[7] ..... A63C 9/00
(52) U.S. Cl. ..... 280/617; 280/14.22
(58) Field of Search ..... 280/14.21, 617, 280/618, 633, 14.22, 14.24, 14.25, 619, 624, 607

(56) References Cited

U.S. PATENT DOCUMENTS

| | | | | | |
|---|---|---|---|---|---|
| 5,660,410 | A | * | 8/1997 | Alden | 280/627 |
| 5,727,797 | A | * | 3/1998 | Bowles | 280/14.2 |
| 5,769,446 | A | * | 6/1998 | Borsoi | 280/14.21 |
| 5,967,531 | A | * | 10/1999 | Saillet | 280/11.36 |
| 5,975,557 | A | * | 11/1999 | Snoke et al. | 280/624 |
| 5,984,325 | A | * | 11/1999 | Acuna | 180/14.21 |
| 6,199,893 | B1 | * | 3/2001 | Fumagalli | 280/602 |
| 6,231,057 | B1 | * | 5/2001 | Reuss et al. | 280/14.21 |
| 6,283,482 | B1 | * | 9/2001 | Coulter | 280/14.22 |
| 6,390,492 | B1 | * | 5/2002 | Baumgarner et al. | 280/607 |

FOREIGN PATENT DOCUMENTS

| | | | |
|---|---|---|---|
| DE | U-91 13766.7 | | 4/1992 |
| EP | 0406212 | | 1/1991 |
| EP | 0439721 | | 8/1991 |
| EP | 0797936 | | 10/1997 |
| EP | 0838248 | | 4/1998 |
| JP | 2000-237370 | * | 9/2000 |
| WO | WO 93/14835 | | 8/1993 |

* cited by examiner

*Primary Examiner*—Brian L. Johnson
*Assistant Examiner*—Bryan Fischmann
(74) *Attorney, Agent, or Firm*—Heslin Rothenberg Farley & Mesiti P.C.; Victor Cardona

(57) ABSTRACT

Board binding (1) comprising a baseplate (2) which has an underside (4) intended to be secured to the board, a highback (3) intended to take the back of the user's boot, the said highback having a mid-plane (10), wherein the board binding is adapted to allow inclination of the mid-plane (10) of the highback (3) with respect to the underside (4) of the baseplate (2).

8 Claims, 7 Drawing Sheets

BOARD BINDING

TECHNICAL FIELD

The invention relates to the field of sports that involve sliding along snow, and more particularly to the sport of snowboarding. It relates more specifically to the bindings intended to be mounted on snowboards, the design of which makes them particularly ergonomic.

PRIOR ART

Numerous types of board binding exist, each type being more particularly suited to a particular style of snowboarding.

Thus, as far as "artistic" snowboarding is concerned, this being the style more commonly known by the name "freestyle", use is made of relatively flexible boots allowing the user great freedom of movement, and allowing the shinbone to be steeply angled with respect to the foot. Its qualities are particularly appreciated when riding on semi-cylindrical tracks most commonly known by the name of "halfpipes".

Thanks to the flexibility of his boots, the rider can adopt particularly inclined positions with respect to the board.

The relative flexibility of the boots also allows a good feel through the board.

The use of such flexible boots entails the use of bindings which have a certain rigidity, particularly in order to resist backthrust.

Thus, such bindings have a baseplate for mounting on the board, and a rear cup forming a highback intended to take the back of the upper of the user's boot. A highback such as this may extend as high as mid-way up the calf.

For bulk reasons, most bindings of this type have a highback which is mounted so that it is articulated with respect to the baseplate, which allows it to be folded down towards the board for transport.

German Patent DE-U-91 13766.7 describes a binding such as this. This binding is equipped with two symmetric stops arranged on the highback and intended to limit the backward inclination of the highback. These stops are adjustable for position in order to adapt the rearmost position of the highback to the user's desires.

It will be appreciated that the vertical position of the highback is not the optimal position for reacting thrust when the leg is slightly inclined with respect to a position perpendicular to the board.

This is a particularly sensitive issue in the so-called "artistic" form of riding in which the rider, in certain phases, adopts a position which is very offset from the normal position.

One problem that the invention sets out to solve is that of the rigidity of the binding and its incompatibility with the need to optimize the inclination of the legs with respect to the board.

SUMMARY OF THE INVENTION

The invention therefore relates to a board binding comprising:

- a baseplate which has an underside intended to be secured to the board;
- a highback intended to take the back of the user's boot, the said highback having a mid-plane.

This binding is characterized in that it comprises means capable of adjusting the inclination of the mid-plane of the highback with respect to the underside of the baseplate.

In other words, the highback of this binding is orientable laterally so as to adjust the inclination of the leg with respect to the board, according to the movement commonly known in snowboarding as "canting".

Thus, unlike conventional bindings in which the plane of symmetry of the highback, which includes the axis of the leg, is perpendicular to the baseplate and therefore to the board, the bindings according to the invention allow the highback, and therefore the leg, to move away from the perpendicular, which proves to be particularly ergonomic, particularly in certain forms of "freestyle".

Thus, by virtue of this arrangement, the position of the leg is optimal for the rider, who can enjoy the rigidity of the highback of the binding to react to backthrust in particular.

The invention covers all kinds of binding designs and, for example, those in which the highback is mounted rigidly with respect to the baseplate, or alternatively still, and as a preference, those in which the highback has the ability to pivot with respect to the baseplate, at right angles to its mid-plane of symmetry.

Specifically, for bulk reasons, it is preferable that the highback be mobile, and be able to be folded down onto the baseplate when there is no boot in the binding.

In this particular instance, the means capable of adjusting the inclination of the highback with respect to the baseplate consist of a number of positions of the axis of pivoting of the highback with respect to the baseplate.

This is because by allowing this axis to adopt a number of positions, and more precisely by allowing it to be inclined with respect to the plane of the board, the plane of symmetry is allowed to adopt a number of orientations moving away from the perpendicular to the board.

In a first embodiment, the baseplate has a number of housings capable of taking fingers mounted on the highback, the said fingers acting as axis of pivoting for the highback with respect to the baseplate.

A series of housings may be formed either on just one side of the baseplate or on both sides, so as to allow inclinations on each side of the vertical. These housings may be arranged vertically, one above the next, or alternatively along a line slightly inclined with respect to the vertical.

In another embodiment, the binding comprises a linking piece collaborating with the baseplate and the highback. This linking piece is mounted with the ability to pivot with respect to the baseplate about a first axis. This linking piece is also capable of adopting, with respect to the highback, a number of positions which are derived from one another by pivoting about a second axis, the first and second axes of pivoting being spatially offset.

In other words, the binding includes an element capable of pivoting both with respect to the baseplate and with respect to the highback, this element forming an eccentric so that its pivoting with respect to the highback offsets the position of the axis of pivoting of the highback with respect to the baseplate, thereby altering the inclination of the axis of pivoting of the highback.

The binding may comprise just one eccentric element located on one side of the binding or may alternatively comprise two eccentric elements collaborating with the baseplate and the highback on each side of the binding, so as to allow the inclination of the plane of symmetry of the highback to be adjusted to each side of the perpendicular to the board.

This linking piece forming an eccentric may be located either on the outside of the baseplate or on the inside face of the highback, or alternatively may be located between the highback and the baseplate.

In practice, the linking piece has a raised zone capable of fitting into a complementary housing belonging to the highback.

Thus, depending on the position of this raised zone in the housing in the highback, the position of the axis of pivoting of the eccentric with respect to the baseplate is modified. The pivoting of the eccentric inside the housing in the highback may be continuous, or in discreet steps.

In this case, the raised zone may comprise a number of identical lobes, distributed about this periphery, the housing in the highback then having a number of recessed zones of a profile that complements these lobes.

The number of lobes determines the number of positions that the eccentric can adopt with respect to the highback, and therefore the accuracy of the canting adjustment.

Advantageously in practice, the linking piece may be secured to the highback either by screwing means or alternatively in a temporary fashion by a cam mechanism actuated by a retractable lever allowing the inclination to be altered without disassembly and without the use of a special tool.

BRIEF DESCRIPTION OF THE FIGURES

The way in which the invention is achieved and its ensuing advantages will become clearly apparent from the description of the following embodiments, in support of the appended figures in which.

DETAILED DESCRIPTION OF THE INVENTION

Figure 1:
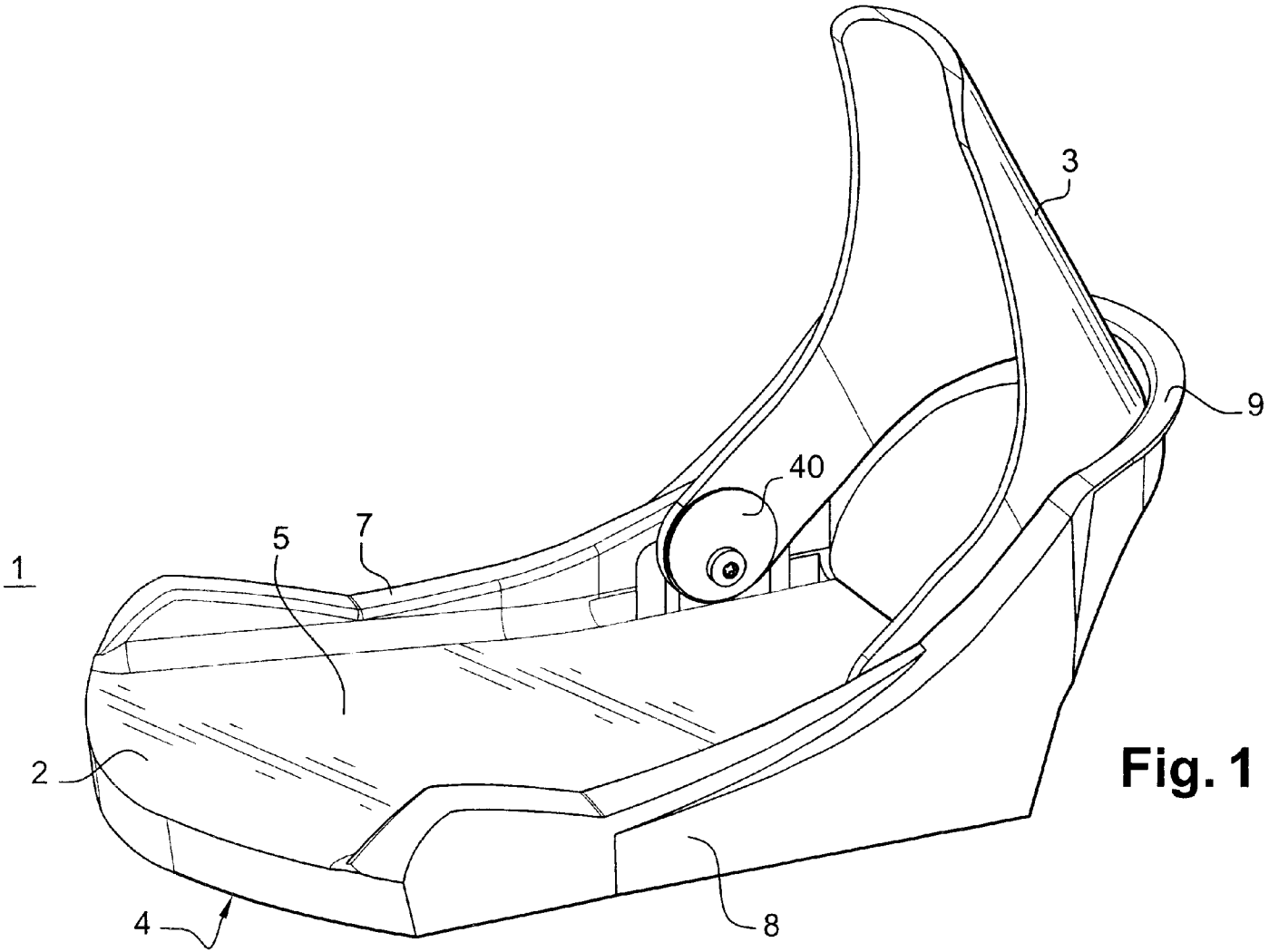
FIG. 1 is a perspective view of a binding according to the invention.

The invention relates to a board binding (1) which, in the known way, comprises a baseplate (2) and a highback (3).

More precisely, the baseplate (2) has an underside (4) which is intended to come into contact with the board, possibly via a platform allowing the binding to be oriented with respect to the longitudinal axis of the board.

A baseplate (2) such as this therefore comprises a mounting plate (5) approximately parallel to the top face of the board, and two lateral flanks (7,8) extended rearward in the form of a bow (9).

Nonetheless, other designs may also be adopted without departing from the scope of the invention.

FIG. 1 does not depict the means for securing the boot to the actual binding, because many solutions can be employed without interfering with the principle of the invention.

The binding (1) therefore comprises, connected to the baseplate, a highback (3) extending approximately mid-way up the leg, and intended to form a cup that takes the back of the user's boot.

In general, bindings such as these are intended to be useable for left or right feet indiscriminately, which means that they have symmetry with respect to the longitudinal mid-plane, at least as far as the part collaborating with the back of the boot is concerned.

This arrangement corresponds to the orientation that exists in bindings of the prior art.

Nonetheless, the invention is not restricted to symmetrical bindings, but also covers bindings which have an asymmetric geometry, particularly an asymmetric highback.

According to one essential feature of the invention, the binding is such that it comprises means allowing the inclination of the mid-plane (10) of the highback (3) to be adjusted with respect to the underside (4) of the baseplate (2).

Figure 2B:
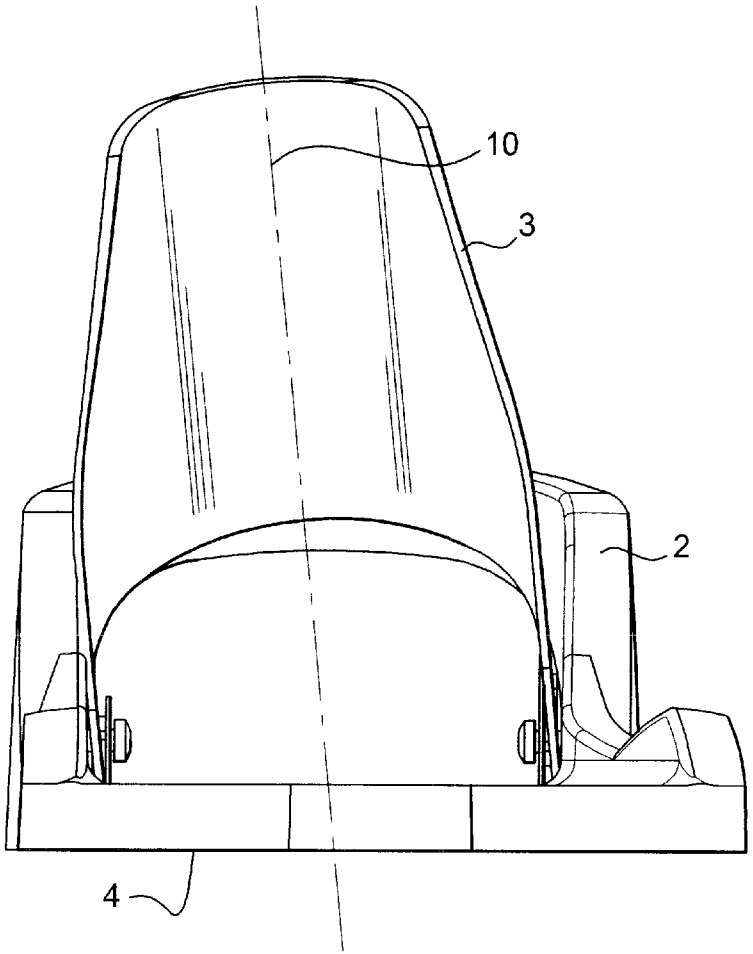
FIG. 2*b* is the binding of FIG. 2*a* in which the highback is inclined with respect to the baseplate.
Figure 2A:
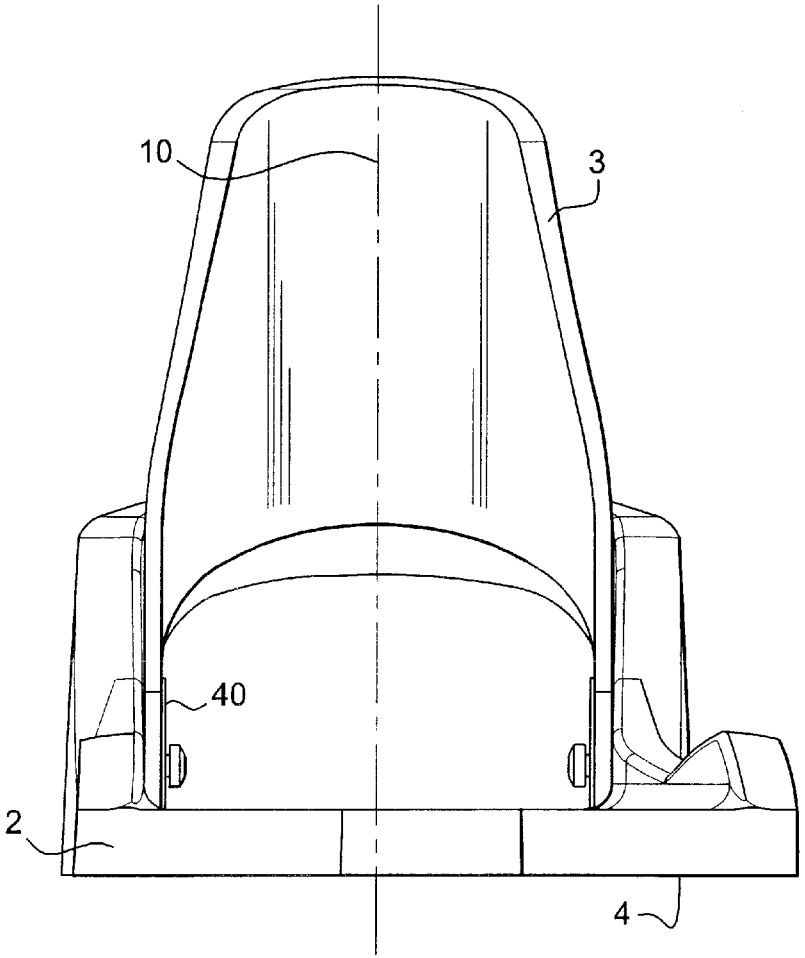
FIG. 2*a* is a front view of the same binding, shown in the position in which the plane of symmetry of the highback is perpendicular to the face of the board.

Thus, the binding illustrated in FIG. 2*a* may, by virtue of this arrangement, find itself in the geometry illustrated in FIG. 2*b* in which the highback (3) is slightly inclined with respect to the vertical.

The bindings illustrated in the appended figures all have a highback which is mounted with the ability to pivot with respect to the baseplate. Nonetheless, the invention also covers variants which have not been depicted and in which this highback is not mounted so that it can pivot with respect to the baseplate, while at the same time retaining the ability for the highback to be inclined laterally.

Figure 3:
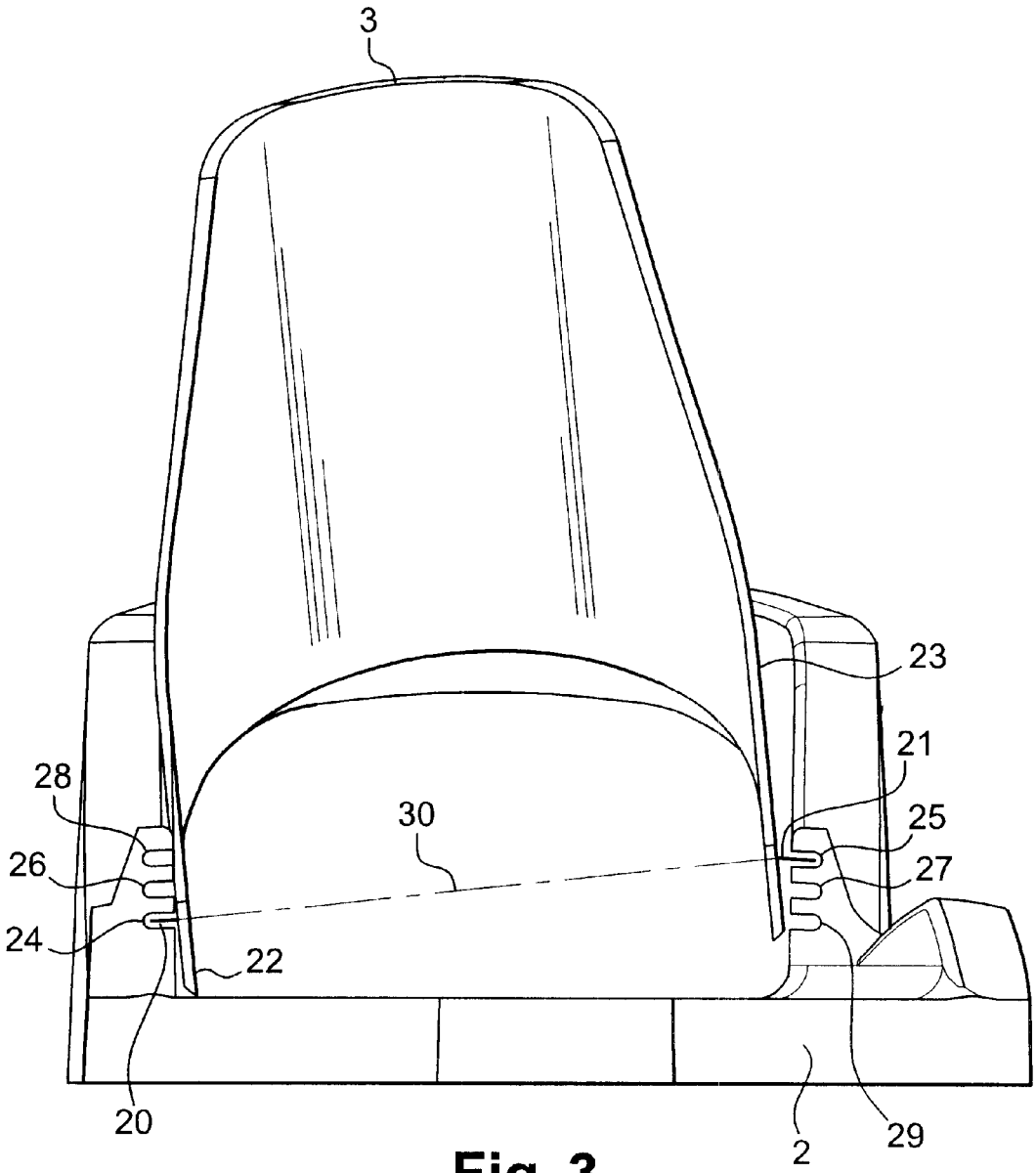
FIG. 3 is a front cross sectional view of the binding of FIG. 1 produced according to the present invention.
Figure 4:
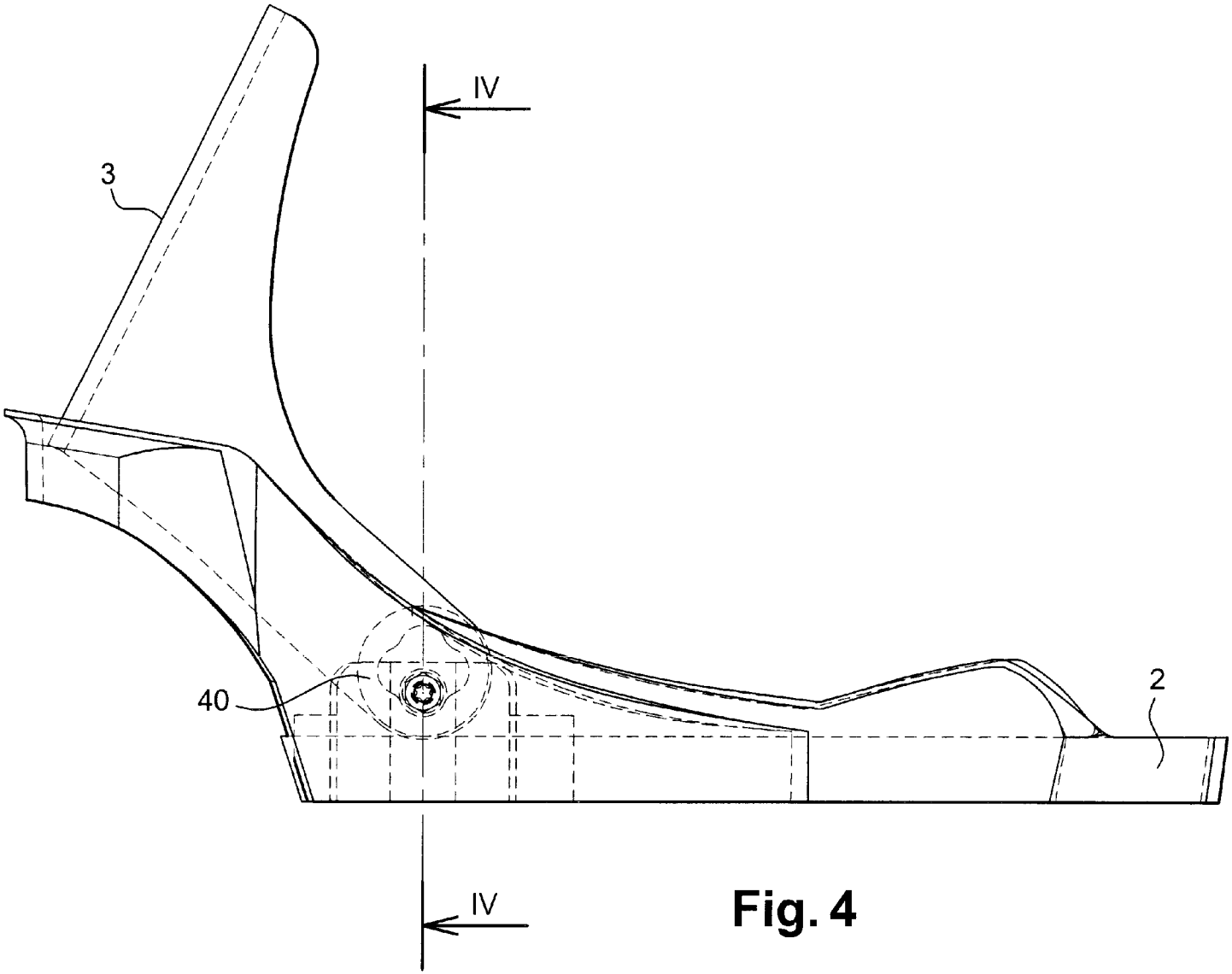
FIG. 4 is a side view of the baseplate of the binding of FIG. 1, showing in phantom the eccentric element on which the highback pivots.

In the embodiment illustrated in FIG. 3, the highback (3) can pivot by the collaboration of two fingers (20,21), each placed on the outer face (22,23) of the highback, in the region of the zone facing the baseplate (2), as well as two complementary housings (24,25) which the fingers (20,21) enter.

The baseplate (2) has a number of housings (24–29) arranged one above the next.

Depending on the housing in which the finger (20,21) of the highback enters, the inclination of the axis of pivoting (30) of the highback (3) with respect to the baseplate (2) varies.

In another embodiment illustrated in FIGS. 4 to 7*c,* the highback (3) pivots with respect to the baseplate (2) by virtue of a linking piece (40) collaborating with the baseplate (2) and the highback (3).

Figure 6:
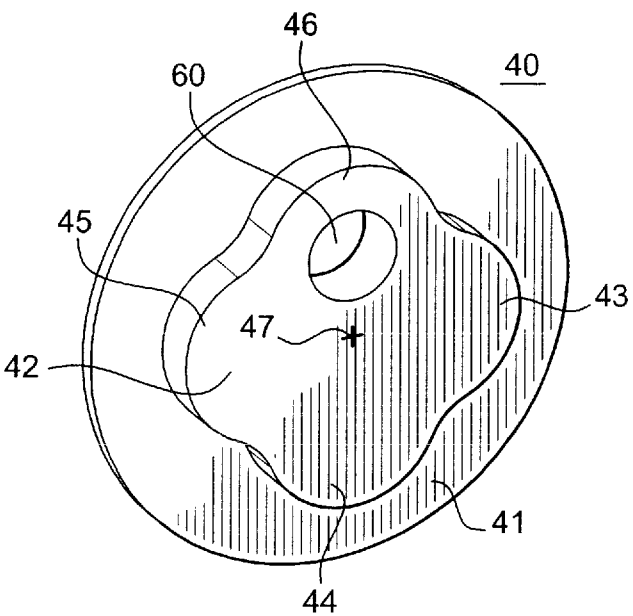
FIG. 6 is a perspective view of the eccentric inking piece.

More specifically, as illustrated in FIG. 6, a linking piece (40) such as this is made up of a disc (41) of reduced thickness, and of a raised zone (42) of constant thickness and comprising four lobes (43–46) arranged symmetrically with respect to the central point (47) of the said raised zone (42).

This raised zone (42) is intended to fit into a complementary housing formed in the bottom part of the highback.

The housing provided in the highback also has a shape including four lobes, so that the linking piece (40) can adopt four different positions derived from one another by rotation by a quarter of a turn about the axis perpendicular to the disc (41) and passing through the centre (47) of the raised zone (42).

As will be evident to one skilled in the art, the invention is not restricted to the geometry illustrated but covers variants in which the number of lobes and the shape of the lobes are markedly different.

To give the linking piece (40) a more accurate adjustment, the raised zone may be provided with finer toothing allowing the position of the linking piece to be adjusted more precisely with respect to the highback.

As a variant, when there are no lobes, this intermediate piece can be adjusted continuously.

Figure 5:
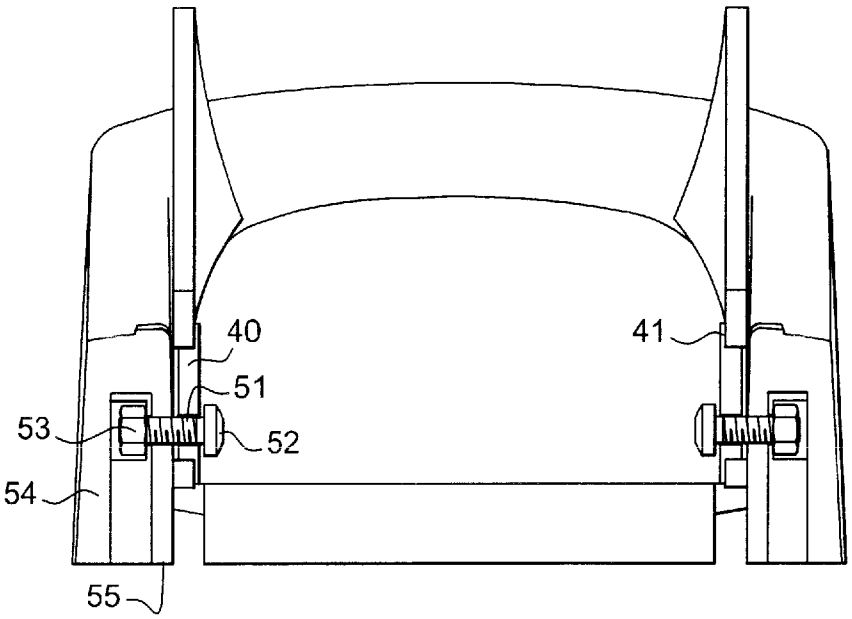
FIG. 5 is a front cross-sectional view of FIG. 4.

As illustrated in FIGS. 5 and 6, the linking piece (40) has a hole (60) intended to take a finger (51) which acts as axis of pivoting of the highback with respect to the baseplate.

Thus, this finger consists of a bolt (52), the head of which comes into contact with the disc (41) of the linking piece (40) and the shank of which extends through the linking piece (40) and all or part of the lateral flank (7) of the baseplate (2).

In the embodiment illustrated in FIG. 5, a nut (53) of the bolt is hidden between two walls (54,55) constituting the lateral flank of the base plate, for aesthetic reasons.

Nonetheless, in other variants which have not been depicted, the bolt may pass through the entirety of the baseplate and emerge at the side, to make position-adjustment manoeuvres easier.

According to one feature of the invention, the finger (51) constituting the axis of pivoting between the highback (3) and the baseplate (2) is offset with respect to the centre (47) of the linking piece (40). By virtue of this arrangement, when the linking piece (40) is pivoted in its housing (50), the finger (51) is moved.

When the two mechanisms located one on each side of the highback (3) are pivoted differently, the axis of pivoting of the highback (3) with respect to the baseplate (2) is therefore inclined with respect to the top face of the board, which gives the highback (3) a certain canting inclination.

Figure 7A:
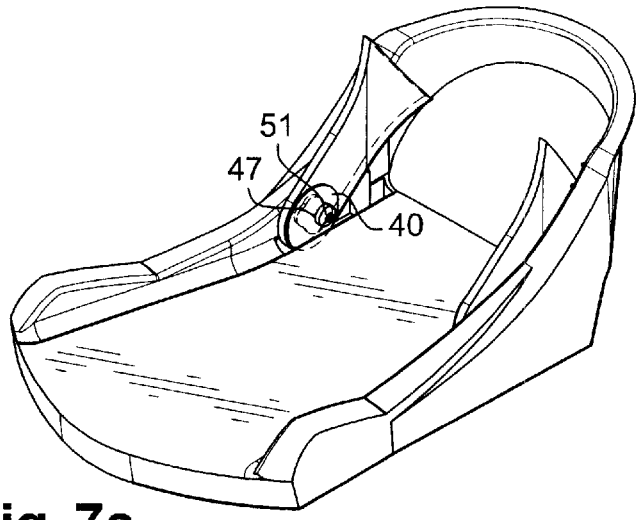
FIG. 7*a* is a perspective view of half of the baseplate of a binding, in which the axis of pivoting of the eccentric element with respect to the highback is at the same level as the axis of pivoting of the eccentric element with respect to the baseplate.
Figure 7B:
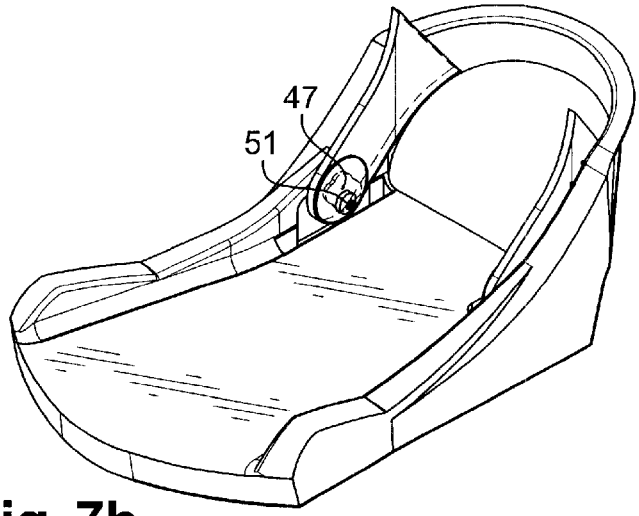
FIGS. 7*b* and 7*c* are variations of FIG. 7*a,* in which the axis of pivoting of the eccentric element with respect to the highback is respectively above and below the axis of pivoting of the eccentric element with respect to the baseplate.
Figure 7C:
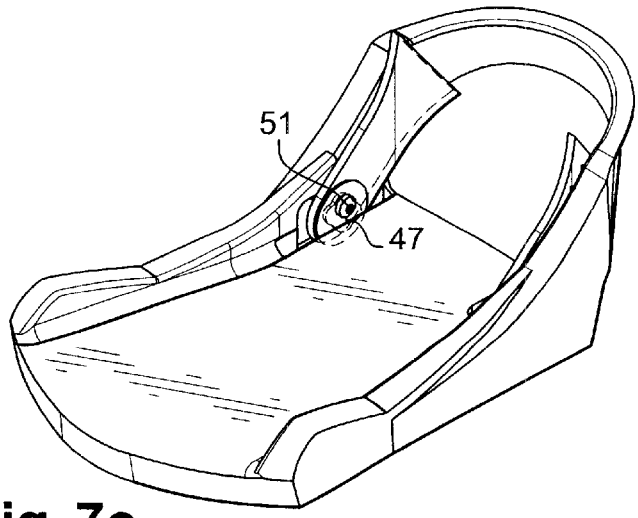
Figure 8:
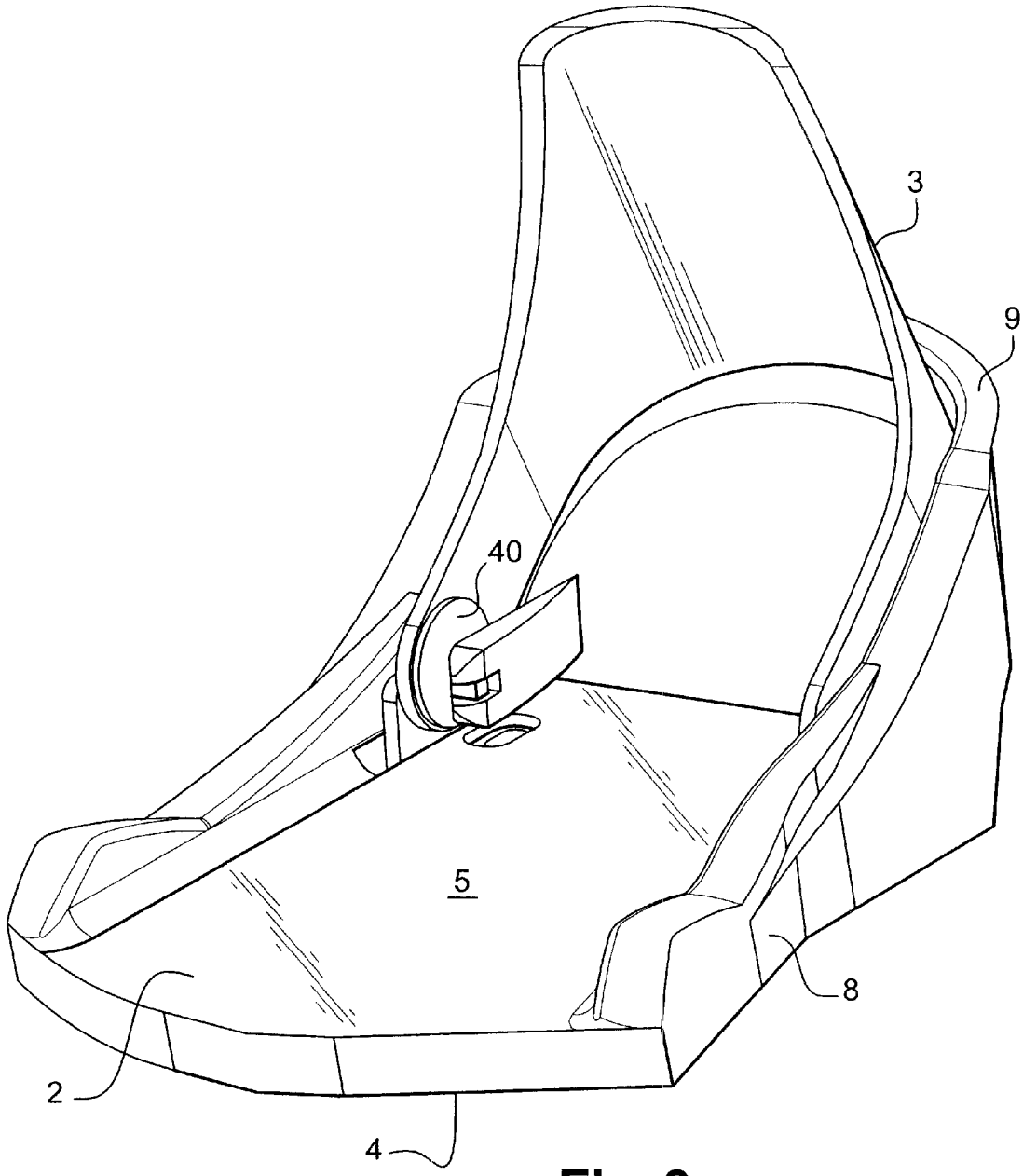
FIG. 8 is a perspective view of another embodiment of a binding having a cam mechanism and a lever for securing a linking piece.

FIGS. 7*a* to 7*c* illustrate, for greater clarity, a number of positions of the linking piece (40) and of the highback (3) with respect to the baseplate (2).

Thus, in FIG. 7*a,* the eccentric linking piece (40) is arranged in such a way that the finger (51) passing through the baseplate is at the same level as the centre (47) of the linking piece.

In FIG. 7*b,* the eccentric piece (40) is pivoted in such a way that the centre (47) of the linking piece, which is fixed with respect to the highback, is located higher up than the finger (51) forming the axis of pivoting with respect to the baseplate.

Thus, on this side of the binding, the highback (3) is raised slightly and the axis of pivoting of the highback (3) with respect to the baseplate (2) is therefore inclined with respect to the main face.

The axis of pivoting of the highback with respect to the baseplate therefore has an opposite inclination to the inclination illustrated in FIG. 7*b.*

As illustrated in FIG. 7*c,* the region where the flank (7) of the baseplate (2) and the mounting plate (5) meet is hollowed out to allow the passage of the disc (41) of the eccentric (40) when the latter is pivoted into a down position, as illustrated in FIG. 7*c.*

As already stated, the binding may be equipped with one or two eccentric elements (40). When each flank of the baseplate comprises an eccentric (40), the inclination of the highback can be doubled by comparison with the embodiments in which the binding has just one eccentric.

It is evident from the foregoing that the board binding according to the invention has numerous advantages and, in particular:

the possibility of adjusting the lateral inclination of the highback with respect to the baseplate, or in other words the "canting", to give the binding an ergonomic geometry;

the possibility of adjusting this inclination in a continuous range of values with extreme precision;

the possibility of adjusting the longitudinal position of the highback.

What is claimed is:

1. A board binding (1) comprising:

a baseplate (2) which has an underside (4) adapted to be secured to a board;

a highback (3) adapted to receive a back of a user's boot, said highback having a mid-plane (10) said highback being pivotable with respect to said baseplate, said baseplate remaining substantially at right angles to said mid-plane (10) during pivoting;

at least one linking piece (40) engaging said baseplate and said highback (3), said linking piece being pivotable with respect to said baseplate about a first axis and capable of adopting a number of positions with respect to said highback, said first axis being spatially offset from a second axis, said second axis being located at the center of the at least one linking piece, and said linking piece having a raised zone (42) receivable in a complementary housing (50) of the highback (3); and wherein the pivoting of said at least one linking piece about the first axis allows the inclination of the mid-plane (10) of the highback (3) to be adjusted around a longitudinal direction of said baseplate.

2. Binding according to claim 1, wherein the adjusting the inclination of the mid-plane of the highback comprises the highback being pivoted through a number of positions of an axis (30) of pivoting of the highback (3) with respect to the baseplate (2).

3. Binding according to claim 2, characterized in that the baseplate (3) has a number of housings (24–29) for receiving fingers (20,21) mounted on the highback (3), said fingers (20,21) acting as an axis of pivoting for the highback (3) with respect to the baseplate (2).

4. Bindings according to claim 1, characterized in that the linking piece is located on the outside of the baseplate.

5. Binding according to claim 1, characterized in that the linking piece (4) is on the inside of the highback (3).

6. Binding according to claim 1, characterized in that the linking piece is located between the baseplate and the highback.

7. Binding according to claim 4, characterized in that a raised zone (42) has a number of identical lobes (43–46) distributed about a periphery of said raised zone, and in that the housing (50) in the highback has a number of recessed zones of profiles that complement the said lobes (43–46).

8. Binding according to claim 1, characterized in that the linking piece is releasably connected to the highback by a cam mechanism actuated by a retractable lever.

* * * * *